US008936411B1

(12) United States Patent
Shaw

(10) Patent No.: US 8,936,411 B1
(45) Date of Patent: Jan. 20, 2015

(54) ARCHITECTURAL CONCRETE

(71) Applicant: Lithocrete, Inc., Costa Mesa, CA (US)

(72) Inventor: Ronald D. Shaw, Corona Del Mar, CA (US)

(73) Assignee: Lithocrete, Inc., Costa Mesa, CA (US)

( * ) Notice: Subject to any disclaimer, the term of this patent is extended or adjusted under 35 U.S.C. 154(b) by 0 days.

(21) Appl. No.: 14/024,953

(22) Filed: Sep. 12, 2013

(51) Int. Cl.
*E01C 7/00* (2006.01)
*E04B 1/16* (2006.01)

(52) U.S. Cl.
CPC .... *E01C 7/00* (2013.01); *E04B 1/16* (2013.01)
USPC ..... 404/75; 404/82; 52/741.41; 264/34

(58) Field of Classification Search
CPC ..... E04B 1/16; E01C 7/00
USPC ..... 404/17, 19–21, 27, 32, 72, 75; 52/741.11–741.41; 264/34
See application file for complete search history.

(56) References Cited

U.S. PATENT DOCUMENTS

| | | | | |
|---|---|---|---|---|
| 2,172,629 | A | 9/1939 | Treuhaft | |
| 2,296,453 | A | 9/1942 | Saffert | |
| 2,925,831 | A | 2/1960 | Welty et al. | |
| 3,441,457 | A | 4/1969 | Regnaud | |
| 3,797,867 | A | 3/1974 | Hartl | |
| 4,697,951 | A | 10/1987 | Allen | |
| 4,748,788 | A | 6/1988 | Shaw et al. | |
| 4,915,888 | A | 4/1990 | Sato | |
| 5,010,982 | A | 4/1991 | Sedlmayr | |
| 5,234,128 | A | 8/1993 | Hill | |
| 5,395,673 | A | 3/1995 | Hunt | |
| 5,794,401 | A | 8/1998 | Shaw et al. | |
| 6,016,635 | A | 1/2000 | Shaw et al. | |
| 6,033,146 | A | 3/2000 | Shaw et al. | |
| 6,610,224 | B2 | 8/2003 | Sullivan | |
| 6,780,369 | B1 | 8/2004 | Darrow et al. | |
| 7,051,483 | B2 | 5/2006 | Bamford | |
| 7,322,772 | B2 | 1/2008 | Shaw et al. | |
| 7,607,859 | B2 | 10/2009 | Shaw et al. | |
| 7,614,820 | B2 * | 11/2009 | Shaw et al. | 404/20 |
| 2003/0140594 | A1 | 7/2003 | Shaw et al. | |
| 2003/0227814 | A1 | 12/2003 | Priesnitz et al. | |
| 2004/0041295 | A1 | 3/2004 | Shaw et al. | |
| 2004/0118025 | A1 | 6/2004 | Shalit | |
| 2008/0112757 | A1 * | 5/2008 | Shaw et al. | 404/75 |
| 2010/0180528 | A1 * | 7/2010 | Shaw | 52/311.1 |
| 2014/0000214 | A1 * | 1/2014 | Vasquez et al. | 52/741.11 |

* cited by examiner

*Primary Examiner* — Raymond W Addie
(74) *Attorney, Agent, or Firm* — Stetina Brunda Garred & Brucker

(57) ABSTRACT

A method of forming architectural concrete in a quicker and more cost effective manner relative to conventional concrete formation methods. The method includes forming the architectural concrete without the use of a surface retarder, and using prescribed amounts of fine sand and aggregate to allow for creation of the desired aesthetic look of the architectural concrete.

9 Claims, 2 Drawing Sheets

ARCHITECTURAL CONCRETE

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field of the Invention

The present invention relates in general to concrete products and more particularly to a method for creating an architectural concrete surface using prescribed amounts of fine sand and aggregate, which enables the architectural concrete surface to be formed without the use of a surface retarder.

2. Description of the Related Art

As is well known in the building and construction trade, concrete is extensively utilized as a building material for several different industrial, commercial and residential applications. Along these lines, due to its durability, water resistance, and cost economy, concrete has gained widespread use. With this widespread use, the public is currently demanding variations in color, surface texture and overall appearance of concrete so that the concrete possesses improved aesthetics similar to more conventional and costly surfaces such as stone, mosaic, and terrazzo.

In order to meet this demand, the concrete trade has developed various coloring and surface finishing techniques to enhance the aesthetics of concrete. Examples of such finishing techniques include salt finish, multiple broom finish, form press finish (e.g. stamped concrete), and exposed aggregate finish. A more detailed description of conventional coloring and finishing techniques may be found in U.S. Pat. Nos. 7,322,772 and 7,607,859, which owned by Lithocrete, Inc., the owner of the present application, and the contents of which are expressly incorporated herein by reference.

Although conventional coloring and surface finishing techniques produce concrete having desired aesthetic characteristics, such conventional techniques oftentimes require extended periods of time to complete the formation process. Furthermore, the extended formation time and the various materials required for such conventional coloring and surface finishing techniques undesirably adds to the overall expense of the concrete product.

Therefore, there exists a need in the art for method of forming a concrete product in a quicker and more cost effective manner, while at the same time maintaining the quality of conventional concrete products. Various aspects of the present invention are directed toward addressing this particular need, as will be discussed in more detail below.

BRIEF SUMMARY

According to various aspects of the present invention, there is provided a method of forming architectural concrete in a quicker and more cost effective manner relative to conventional concrete formation methods. The method generally includes forming the architectural concrete without the use of a surface retarder, and using prescribed amounts of fine sand and aggregate to allow for creation of the desired aesthetic look of the architectural concrete.

According to one embodiment, the method includes forming the architectural concrete upon a subgrade by pouring a concrete mixture over the subgrade such that the concrete mixture defines an exposed surface. A quantity of fine sand is broadcast over the exposed surface of the concrete mixture. Additionally, a quantity of aggregate is broadcast over the exposed surface of the concrete mixture. The fine sand and aggregate are manipulated to simulate the appearance of quarried stone. The architectural concrete resulting from the method is formed independent of applying a surface retarder to the concrete mixture.

The step of broadcasting a quantity of fine sand may include broadcasting fine sand over approximately 15-85% of the exposed surface of the concrete mixture. The step of broadcasting a quantity of aggregate may include broadcasting aggregate over approximately 15-85% of the exposed surface of the concrete mixture. The fine sand and the aggregate may be broadcast over the exposed surface pneumatically. The aggregate may be broadcast over the exposed surface after the fine sand has been broadcast over the exposed surface, and while the concrete mixtures is in a plastic state. The fine sand may be of a given color corresponding to the simulated quarried stone.

The method may further include finishing the exposed surface of the concrete mixture to dispose a quantity of cement/fines paste derived from the concrete mixture at the exposed surface thereof, the manipulating step including mixing the fine sand and aggregate into the cement/fines paste.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and detailed description to indicate like elements.

DETAILED DESCRIPTION

Figure 1:
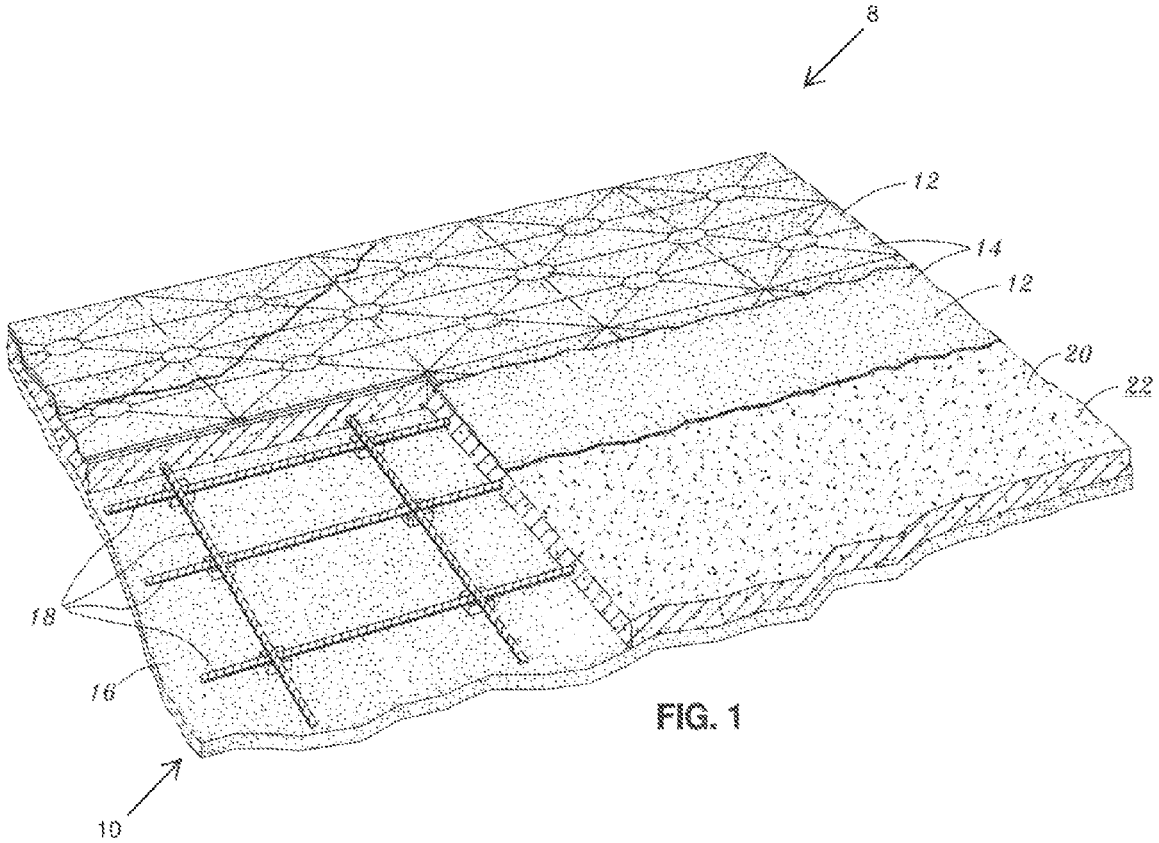
FIG. 1 is a partial sectional upper perspective view illustrating various stages of preparing surface seeded architectural concrete according to an embodiment of the present invention.
Figure 2:
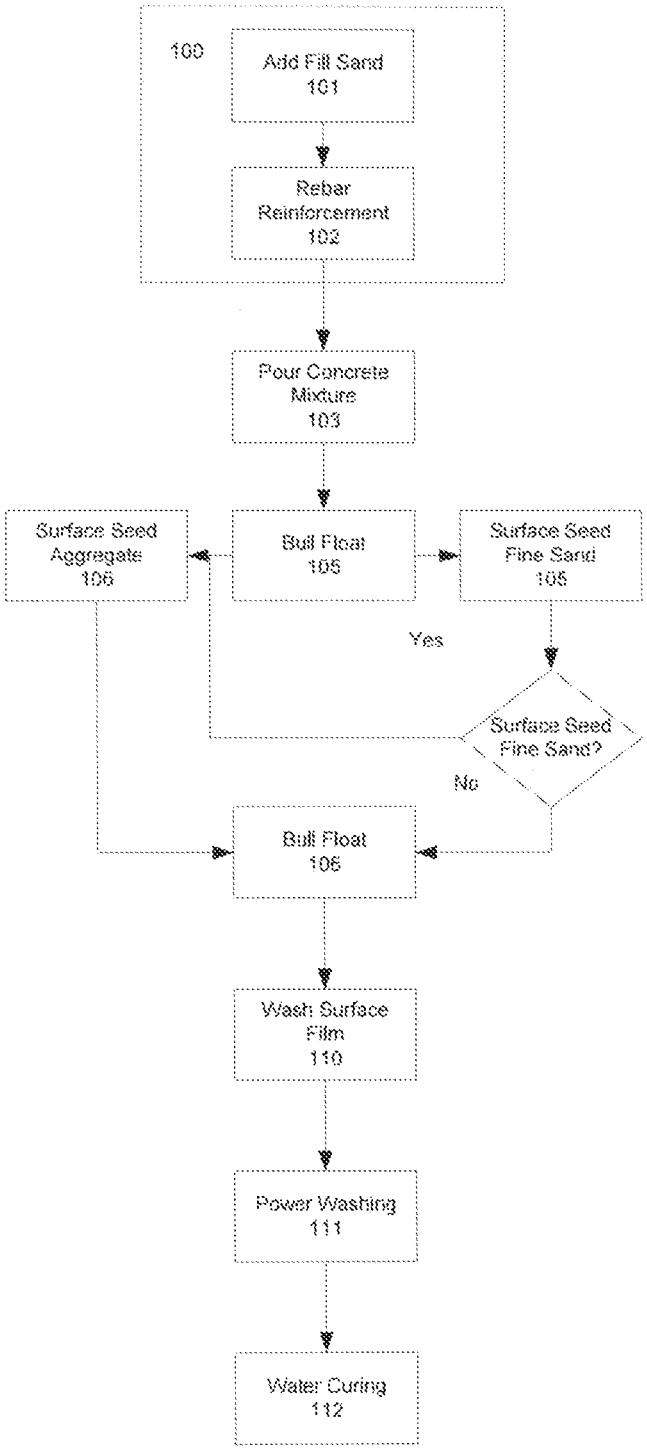
FIG. 2 is a schematic diagram illustrating steps of a method of producing the surface seeded architectural concrete in accordance with an embodiment of the present invention.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now specifically to the drawings, wherein the showings are for purposes of illustrating a preferred embodiment of the present invention only, and are not for purposes of limiting the same, there is shown an embodiment of an architectural concrete structure 8 and a related method of forming the same. Preferred embodiments of forming the architectural concrete 8 utilize surface seeded exposed aggregate upon a subgrade 10. Various aspects of the present invention result in architectural concrete 8 which simulates quarried stone which precisely models the fine, medium, and/or course grain textures of natural quarried stone, as well as the flex, speckles, and inclusions that are also present in natural quarried stone. The architectural concrete 8 is preferably formed using prescribed amounts of fine sand 12 and aggregate 14, which allows the architectural concrete 8 to be formed without the use of a surface retarder to achieve cost savings and quicker formation times. While most conventional concrete formation methods require the use of a surface retarder, the unique combination of the prescribed amounts of fine sand and aggregate used allows the architectural concrete to be formed without the surface retarder.

An embodiment of the architectural concrete 8 may be formed after properly preparing a subgrade 10, which may be prepared in a variety of ways, utilizing a variety of tools, materials, and methods. One such method of preparing the subgrade 10 includes an initial step of preparing the subgrade 10 to a desired elevation and grade and compacting the same to preferably 90% compaction. Subsequent to this preparation, the subgrade 10 is preferably covered with a layer of clean, moist fill sand 16, which preferably defines a minimum thickness of four inches. The use of fill sand 16 is preferable for controlling the hydration process of the concrete. In this regard, it is contemplated that other embodiments of the present invention may not include fill sand 16 in the preparation of the subgrade 10.

Reinforcement members (e.g., rebars) 18 may be used in the architectural concrete structure 8 to increase the resultant strength thereof, and to mitigate the likelihood of cracking within the concrete. The reinforcement members 18 may be positioned upon the layer of fill sand 16 to define a lattice framework, or other arrangements known by those skilled in the art. The reinforcement members 18 and the fill sand 16 are generally referred to collectively as the subgrade 10.

A concrete mixture 20 is poured over the subgrade 10 so as to encapsulate the reinforcement members 18 within the concrete mixture 20. The concrete mixture 20 is preferably poured to define a depth of approximately 3.5-4.0 inches, although other depths may also be defined by the concrete mixture 20. Although variations in the concrete mixture 20 are contemplated, a preferred concrete mixture 20 comprises 70% sand and 30% aggregate having a mean diameter of ⅜ inch, combined with six sack cement (2,000 pounds per square inch) or seven sack cement (3,000 pounds per square inch). It is additionally contemplated that various color mixtures/additives may be added to the concrete mixture 20 to achieve a desired appearance.

After the concrete mixture 20 has been poured, the mixture 20 is preferably screeded to a desired level plane or grade such that the concrete mixture 20 defines a generally level or planar upper exposed surface 22. Subsequent to screeding, the exposed surface 22 of the concrete mixture 20 is surfaced or finished to dispose a quantity of the cement/fine paste derived from the concrete mixture 20 at the exposed surface 22 thereof. This finishing may be done utilizing vibrating bull float, which typically possesses an extremely smooth or polished surface which, in addition to bringing up the appropriate amount of cement/fine paste also tends to seal the exposed surface 22 of the concrete mixture 20. The vibrating bull float may be a vibrating metal bull float, such as a vibrating magnesium bull float or a vibrating aluminum bull float. An exemplary metal bull float is sold under the trademark HAL200 by the Lievers Holland Co.

While the exposed surface 22 of the concrete mixture 20 is still in a plastic state, fine sand 12 is broadcast over the exposed surface 22. The fine sand 12 may be of any given color or texture, as is required to produce the simulated quarried stone. Along these lines, it is contemplated that various combinations of color, texture or other characteristics of the fine sand 12 may be employed to create the appearance of the simulated quarried stone. In this regard, multiple types of fine sand 12 may be used in a given project to produce the desired aesthetic effects, while in other instances, only a single type of fine sand 12 may be used.

The coloring and/or patterns created utilizing the fine sand 12 may be produced dependent upon the manner in which is fine sand 12 is broadcast upon the exposed surface 22. The fine sand 12 may be utilized to produce an overall shade or color as the simulated quarried stone, or may be alternated with other colors of the fine sand or quantity thereof to simulate the various aspects of natural quarried stone such as graining, fractures, joints, knots, crystallization patterns, sand seams, streaks, subjoints, weathering, and/or rock texture properties such as porphyritic, ophitic, and orei.

The fine sand 12 is preferably broadcast over 15-85% of the exposed surface 22 of the concrete mixture 20. In certain embodiments, the fine sand 12 is broadcast over 65-85% of the exposed surface 22, while in other embodiments, the fine sand 12 is broadcast over 75-85% of the exposed surface. As will be explained in more detail below, broadcasting fine sand 12 over 15-85% of the exposed surface 22 of the concrete mixture 20 allows the architectural concrete 8 to be formed without the use of a surface retarder, which in turn enables quicker formation times and reduced overall costs relative to conventional techniques requiring the use of a surface retarder.

In addition to broadcasting fine sand 12, a quantity of aggregate 14 is additionally broadcast upon the exposed surface 22 of the concrete mixture 20. As with the fine sand 12, the aggregate 14 is preferably broadcast over 15-85% of the exposed surface of the concrete mixture. Although, in certain embodiments, the aggregate 14 is broadcast over 65-85% of the exposed surface 22, while in other embodiments, the aggregate 14 is broadcast over 75-85% of the exposed surface. In some cases, the same amount of fine sand 12 and aggregate 14 may be used, while in other cases, different amounts/percentages of fine sand 12 and aggregate 14 may be used in order to achieve the desired aesthetic effect. As noted above, the prescribed quantities of fine sand 12 and aggregate 14 allow the architectural concrete 8 to be formed without the use of a surface retarder.

Furthermore, as mentioned above in relation to the fine sand 12, the characteristics of the aggregate 14, such as the color, texture or size may be varied as required in order to simulate the quarried stone. For instance, in order to simulate the flex, speckles, and inclusions of natural quarried stone, it is contemplated that the aggregate 14 may contrast the fine sand 12, or alternatively, that the aggregate 14 may be utilized to compliment the fine sand 12 and thereby simulate natural quarried stone. As is known by one of skill in the art, quarried stone may be of various types, such as granite, marble, rhinestone, bluestone, and brownstone, to name a few.

The absence of the surface retarder allows the architectural concrete 8 to be formed quicker than conventional methods. In particular, the current method does not require time for the surface retarder to be applied to the architectural concrete 8. Furthermore, the absence of the surface retarder reduces the overall cost of the method, since fewer materials are used to construct the architectural concrete 8.

It is contemplated that the aggregate 14 and fine sand 12 may be matched in various combinations of color, size, pattern, etc., to produce the various effects that natural quarried stone displays, such as graining, fractures, joints, knots, crystallization patterns, sand seams, streaks, subjoints, weathering, rock texture properties such as porphyritic, ophitic, and orei, etc. In addition, the quantity of fine sand 12 and/or the aggregate 14 per unit area may also be varied to simulate natural quarried stone. Furthermore, it is contemplated that the exposed surface 22 may be cut corresponding to a surface design, as is required to produce simulated quarried stone. The cuts may be done according to the requirements of a given project, such as straight cuts, cuts of any geometry, or cuts to simulate the shape and texture of natural quarried stone.

According to an implementation of the present invention, it is contemplated that the broadcasting of the fine sand 12 and the aggregate 14 may be performed utilizing pneumatic equipment. In this regard, the pneumatic equipment may allow an operator to be more precise and even in the placement of the fine sand 12 and/or aggregate 14 during broadcasting. As mentioned, the use of pneumatic equipment may allow the fine sand 12 and/or the aggregate 14 to be evenly spread upon the exposed surface 22; however, it is also contemplated that the pneumatic equipment may allow the operator to produce a randomized pattern or a design corresponding to a particular natural quarried stone. Thus, the appearance of the exposed surface 22 may be enhanced utilizing other tools such as pneumatic equipment.

After being broadcast upon the exposed surface 22 of the concrete mixture 20, the fine sand 12 and the aggregate 14 are mixed or worked into the exposed surface 22 of the concrete mixture 20, and more particularly are mixed into the cement/fine paste of the exposed surface 22. In implementations of the present invention, this step may be utilized to further enhance the physical placement of the fine sand 12 and the aggregate 14 on the exposed surface 22. It is contemplated that this step may be variously performed in order to create various effects that natural quarried stone displays, such as graining, fractures, joints, knots, crystallization patterns, sand seams, streaks, subjoints, weathering, rock texture properties such as porphyritic, ophitic, and orei, etc. This may be accomplished utilizing a power trowel. However, it is contemplated that the mixing may be accomplished utilizing other devices known in the art. This mixing of the fine sand 12 and the aggregate 14 with the cement/fine paste at the exposed surface 22 is also critical to the process of the present invention because it ensures that the fine sand 12 and the aggregate 14 are fully embedded into the cement/fine paste and thus thoroughly adhered or bonded to the exposed surface 22 of the concrete mixture 20 upon resultant curing.

Subsequent to the mixing of the fine sand 12 and the aggregate 14 into the cement/fine paste at the exposed surface 22 of the concrete mixture 20, the exposed surface 22 may be finished with a power trowel to properly level and finish the exposed surface 22.

The exposed surface 22 of the concrete mixture 20 may be washed with water to remove any surface films therefrom. In this washing procedure, it may be preferable to lightly brush the exposed surface 22 with a bristle brush. This may be done according to design requirements in creating a simulated quarried stone appearance. The washing step, as described herein, may be done without excessive dislodgement and loss of the fine sand 12 or the aggregate 14.

Subsequent to washing, the concrete mixture 20 may be hardened/cured utilizing water alone, as opposed to chemical curing agents in order to avoid staining of the exposed surface 22. Such water hardening/curing may typically be facilitated through the use of a conventional fogger or soaker hose. After a prescribed period of time (e.g., 30 days after initiating the hardening/curing process) any surface residue present on the exposed surface 22 is removed by conventional power washing with a ninety percent (90%) steam and ten percent (10%) muriatic acid mixture which is applied by a power washer via a high pressure nozzle.

The resultant surface exhibits an appearance of natural quarried stone. Further, as an extremely flat surface seeded exposed aggregate surface, it is also suitable for high pedestrian traffic. As described above, various modifications in the color, size, texture, and other characteristics of the fine sand 12 and the aggregate 14 may be modified in order to produce numerous types of simulated quarried stone.

The above description is given by way of example, and not limitation. Given the above disclosure, one skilled in the art could devise variations that are within the scope of the invention disclosed herein, including various ways of creating different textures, utilizing various types of surface forming tools, etc. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of forming architectural concrete upon a subgrade, the method comprising the steps of:

pouring a concrete mixture over the subgrade, the concrete mixture defining an exposed surface;

broadcasting a prescribed quantity of fine sand over approximately 15-85% of the exposed surface of the concrete mixture;

broadcasting a prescribed quantity of aggregate over approximately 15-85% of the exposed surface of the concrete mixture; and manipulating the fine sand and aggregate to simulate the appearance of quarried stone;

wherein the prescribed quantities of fine sand and aggregate broadcast over the exposed surface of the concrete mixture allow the architectural concrete to be formed independent of applying a surface retarder to the concrete mixture.

2. The method recited in claim 1, wherein the step of broadcasting a quantity of fine sand includes broadcasting fine sand over approximately 65-85% of the exposed surface of the concrete mixture.

3. The method recited in claim 1, wherein the step of broadcasting a quantity of fine sand includes broadcasting fine sand over approximately 75-85% of the exposed surface of the concrete mixture.

4. The method recited in claim 1, wherein the step of broadcasting a quantity of aggregate includes broadcasting aggregate over approximately 65-85% of the exposed surface of the concrete mixture.

5. The method recited in claim 1, wherein the step of broadcasting a quantity of aggregate includes broadcasting aggregate over approximately 75-85% of the exposed surface of the concrete mixture.

6. The method recited in claim 1, further comprising the step of:

finishing the exposed surface of the concrete mixture to dispose a quantity of cement/fines paste derived from the concrete mixture at the exposed surface thereof, the manipulating step including mixing the fine sand and aggregate into the cement/fines paste.

7. The method recited in claim 1, wherein the fine sand and the aggregate are broadcast over the exposed surface pneumatically.

8. The method recited in claim 1, wherein the aggregate is broadcast over the exposed surface after the fine sand has been broadcast over the exposed surface, the aggregate being broadcast while the concrete mixtures is in a plastic state.

9. The method recited in claim 1, wherein the fine sand is of a given color corresponding to the simulated quarried stone.

* * * * *